United States Patent [19]

Vaughn et al.

[11] Patent Number: 5,031,912

[45] Date of Patent: Jul. 16, 1991

[54] THERAPY STEERING WHEEL FOR WHEELCHAIR

[76] Inventors: Mark E. Vaughn, 1714 Inlet Dr., North Fort Myers, Fla. 33903; Blanche O. Wenger, 5757 Flamingo Dr., Cape Coral, Fla. 33904

[21] Appl. No.: 507,041

[22] Filed: Apr. 10, 1990

Related U.S. Application Data

[63] Continuation-in-part of Ser. No. 442,303, Nov. 28, 1989, abandoned.

[51] Int. Cl.[5] ..... A63B 21/22

[52] U.S. Cl. ..... 272/132; 272/143

[58] Field of Search ..... 272/93, 131, 132, 143, 272/67, 68; 434/247

[56] References Cited

U.S. PATENT DOCUMENTS

| | | | |
|---|---|---|---|
| 3,204,367 | 9/1965 | Stubbmann | 446/227 |
| 3,511,500 | 5/1970 | Dunn | 272/132 X |
| 3,647,210 | 3/1972 | Ratcliffe | 272/83 A |
| 3,995,853 | 12/1976 | Deluty | 272/132 |
| 3,999,778 | 12/1976 | Markiel | 280/289 |
| 4,337,050 | 6/1982 | Engalitcheff, Jr. | 272/130 X |
| 4,408,759 | 10/1983 | Reneau et al. | 272/131 |
| 4,484,755 | 11/1984 | Houston | 280/33.9 |
| 4,765,614 | 7/1988 | Shute | 272/130 X |
| 4,824,132 | 4/1989 | Moore | 272/73 X |
| 4,846,156 | 7/1989 | Kopnicky | 272/134 X |
| 4,883,268 | 11/1989 | Salkind | 272/130 X |
| 4,911,435 | 3/1990 | Johns | 272/134 |

*Primary Examiner*—Richard J. Apley
*Assistant Examiner*—L. Thomas
*Attorney, Agent, or Firm*—Merrill N. Johnson

[57] ABSTRACT

An automobile steering assembly to be mounted on a wheelchair for therapeutic purposes. The steering wheel is rotatably mounted on a plate attached to the horizontal center section of a tubular frame which fits onto the frame of the wheelchair. The steering wheel is positioned so that it is presented to the person seated in the wheelchair in the same position that the steering wheel of an automobile is presented to the seated driver of the automobile so that the person in the wheelchair can grasp the steering wheel as though he or she were the driver of an automobile. The steering wheel is mounted so it can be rotated or turned about its central axis similarly to the turning of an automobile steering wheel. However, unlike an automobile steering wheel, the therapy steering wheel includes manually adjustable means for varying the amount of force required to turn the therapy steering wheel.

4 Claims, 1 Drawing Sheet

FIG. 1
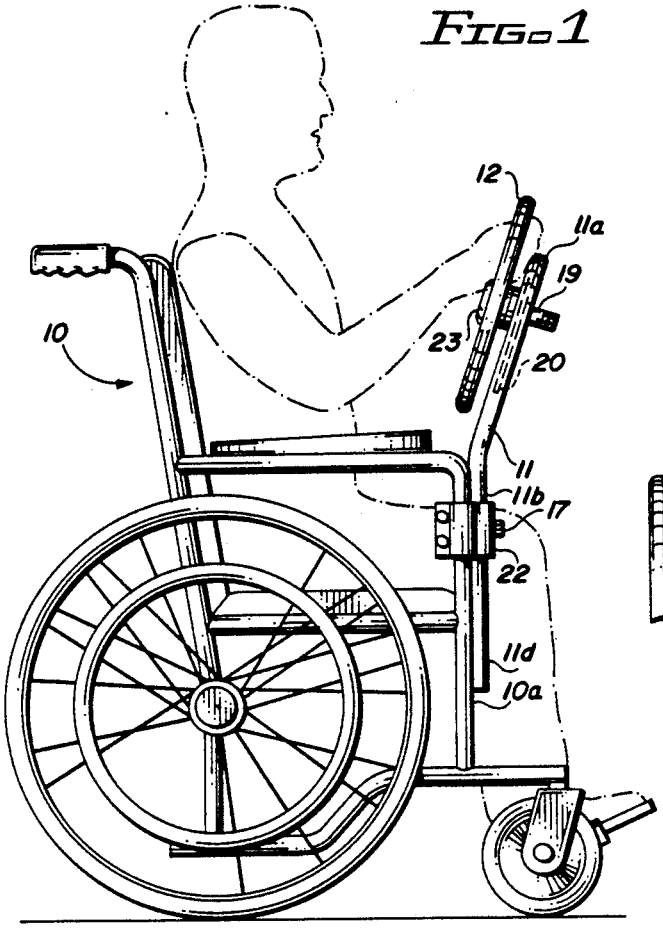
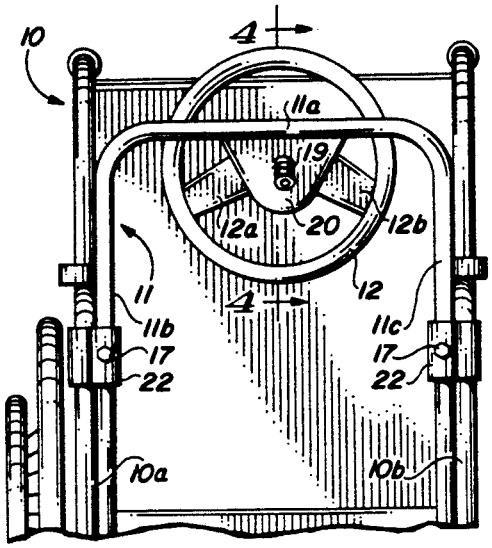
FIG. 2
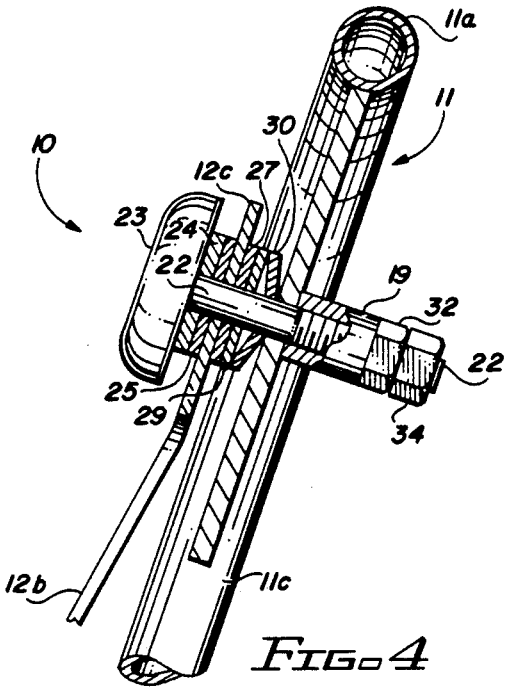
FIG. 4
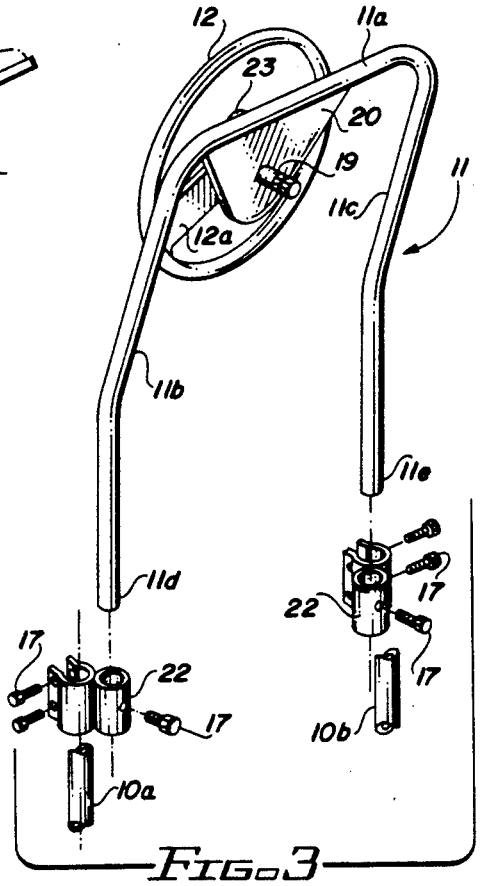
FIG. 3

THERAPY STEERING WHEEL FOR WHEELCHAIR

This application is a continuation-in-part of our earlier application Ser. No. 07/442,303 filed Nov. 28, 1989 now abandoned.

BACKGROUND AND SUMMARY OF THE INVENTION

Our invention relates to a therapeutic device for persons usually confined to a wheelchair especially children and adults suffering from some form of mental illness.

Many persons who are voluntarily or involuntarily confined to a wheelchair during their waking hours desire or will be benefitted by something to do with their hands. many wheelchair patients will derive benefits both physically and mentally from being kept busy and having had extensive movement of their hands and arms on a daily basis.

Accordingly, we have invented a therapy steering wheel assembly to be mounted on a wheelchair for therapeutic purpose. The therapy steering wheel is made to resemble the wheel of an automobile and is rotatable on a plate attached to the horizontal center section of a tubular frame which fits onto the front frame of a wheelchair.

The therapy steering wheel is positioned so that it is presented to the person in the wheelchair in the same position that the steering wheel of an automobile is presented to the seated driver of the automobile. Thus the person seated in the wheelchair can grasp the therapy steering wheel as though he or she were the driver of an autombile. However, unlike an automobile steering wheel, our steering wheel assembly includes a manually adjustable means for varying the amount of force required to turn the wheel.

The exact shape and dimensions of the frame used to attach the steering wheel onto the front of the wheelchair may be varied depending upon the construction of the wheelchair. The important thing is to have the therapy steering wheel presented to the patient seated in the chair, whether he or she may be a child or an adult, similarly to the way an autombile steering wheel is presented to the driver of the automobile.

We have found that a tubular frame is readily adaptable to different wheelchairs and different sized occupants of the wheelchair, especially when the tubular frame is made of chrome plated or stainless steel.

BRIEF DESCRIPTION OF THE DRAWINGS

The appended drawings illustrate a preferred embodiment of our therapy steering wheel assembly in which FIG. 1 is a right side elevational view of our therapy steering wheel assembly mounted onto a conventional wheelchair with a person shown in dotted lines seated in the chair and grasping our steering wheel;

FIG. 2 is a front elevational view of the therapy steering wheel shown in FIG. 1;

FIG. 3 is an exploded perspective view of our therapy steering wheel assembly and its mounting brackets: and FIG. 4 is a detailed cross-sectional view taken along line 4—4 of FIG. 2 of the manually adjustable mechanism for increasing or decreasing the amount of force needed to turn the therapy steering wheel.

DETAILED DESCRIPTION OF THE PREFERRED EMBODIMENT

A conventional tubular-framed wheelchair 10 onto which is mounted our therapy steering wheel assembly as shown in FIGS. 1 and 2 of the appended drawings.

Wheelchair 10 includes a tubular frame, a seat and back, a pair of large back wheels, a pair of small front wheels, a foot rest, and a pair of hand grips, all as shown in FIGS. 1 and 2 but not numbered since they form no part of our invention. Wheelchair 10 also includes a pair of similar front vertical tubular members 10*a* and 10*b* best shown in FIG. 2 to which are attached our therapy steering wheel assembly.

The assembly includes a tubular frame 11 having horizontal center section 11*a*, a pair of intermediate angled sections 11*b* and 11*c*, and a pair of similar vertical end sections 11*d* and 11*e* best shown in FIG. 3 of the drawings. A retaining plate 20 is welded to the bottom edge of horizontal center section 11*a* of the tubular frame.

A cylindrical hole is drilled through retaining plate 20 and a hollow cylinder 19 having the same internal diameter as the hole in plate 20 is aligned with the hole and welded to the back side of the plate to form a cylindrical passageway for mounting onto plate 20 the steering wheel 12 and the mechanism for adjusting the force required to turn the steering wheel.

Steering wheel 12 is sized and designed to resemble a conventional automobile steering wheel with spokes 12*a* and 12*b* connected to an axially centered mounting hub 12*c* as shown in FIG. 4 of the drawings.

Steering wheel 12 is mounted onto retaining plate 20 by a cylindrical shaft 22 sized to fit within the passageway in cylinder 19. Shaft 22 has one end threaded and a cap-shaped knob 23 mounted on the other end of shaft. A spacer ring 24 encircles the shaft and rests against the back side of knob 23. Friction clutch plate 25 lies next to spacer ring 24. The steering wheel is next placed upon shaft 22 with its hub 12*c* against clutch plate 25. A second friction clutch plate 27 is then placed on shaft 22 next to the hub of the steering wheel, followed by a second spacer member 29 and finally a belleville spring 30.

The threaded end of shaft 22 together with its shaft-encircling spacer ring 24, clutch plate 25, steering wheel 12, second clutch plate 27, second spacer ring 29 and belleville spring 30 is inserted into and through the passageway in cylinder 19, and a pair of nuts 32 and 34 is then threaded onto the end of shaft 22 which projects from cylinder 19.

With the steering wheel 12 thus mounted on plate 20, the wheel is free to turn or rotate about its axis on shaft 22. Manually turning of knob 23 clockwise tends to cause belleville spring 30 to flex and increase the friction between clutch plates 25 and 27 and the opposite faces of steering wheel hub 12*c*. Thus manual turning of knob 23 clockwise or counterclockwise will permit the therapist or other person to adjust the tension on the hub of the steering wheel so as to change the force required by the patient in the wheelchair to turn the steering wheel.

The entire steering wheel is mounted onto the wheelchair 10 by a pair of clamping brackets 22 best shown in FIG. 3. Brackets 22 are clamped onto wheelchair front vertical tubular frame members 10*a* and 10*b* by screws 17. Then ends 11*d* and 11*e* of assembly 11 are inserted into brackets 22 as shown in FIG. 3. By suitable positioning of brackets 22 on wheelchair frame members 10*a* and 10*b* and on frame members 11*d* and 11*e*, steering wheel 12 can be positioned in front of the patient sitting in wheelchair 10 similarly to the position of an automobile steering wheel in relation to the seated driver of the automobile.

The therapist or person in charge of the patient in the wheelchair can then adjust the amount of force required to turn steering wheel 12 by turning knob 23.

While we have illustrated our therapy steering wheel assembly, various modifications and rearrangements will be apparent to those skilled in the art without departing from the spirit and scope of our invention. The scope of our invention is limited only by the following claims.

We claim:

1. A steering wheel assembly to be attached to a wheelchair for therapeutic purposes comprising an automobile steering wheel rotatably mounted on a plate, manually adjustable means mounted on the plate for varying the amount of force required to turn the rotatable steering wheel, and said plate being mounted on a generally U-shaped tubular frame designed and sized for attachment to a wheelchair so that the steering wheel is positioned in front of a person seated in the wheelchair similarly to the position of an automobile steering wheel in front of the driver of the automobile.

2. A steering wheel assembly as set forth in claim 1 wherein the manually adjustable means includes a pair of clutch plates bearing against the steering wheel.

3. A steering wheel assembly for attachment onto the front of a wheelchair to be used for therapeutic purposes by the person seated in the wheelchair comprising a steering wheel designed and sized like an automobile steering wheel rotatably mounted upon a plate, manually adjustable means mounted on the plate for varying the amount of force required to axially rotate the steering wheel, and a generally U-shaped tubular frame having a horizontal center section which supports the plate and which is designed and sized for attachment to the front of a wheelchair so that the steering wheel is positioned in front of a person seated in the wheelchair similarly to the position of an automobile steering wheel in front of the driver of the automobile.

4. A steering wheel assembly as set forth in claim 3 wherein the manually adjustable means includes a belleville spring axially aligned with a clutch plate bearing against the steering wheel.

* * * * *